US009082566B2

(12) United States Patent
Chen

(10) Patent No.: US 9,082,566 B2
(45) Date of Patent: Jul. 14, 2015

(54) BACKLIGHTING ASSEMBLY FOR A KEYPAD

(75) Inventor: Chao Chen, Waterloo (CA)

(73) Assignee: BLACKBERRY LIMITED, Waterloo (CA)

( * ) Notice: Subject to any disclaimer, the term of this patent is extended or adjusted under 35 U.S.C. 154(b) by 152 days.

(21) Appl. No.: 12/874,269

(22) Filed: Sep. 2, 2010

(65) Prior Publication Data

US 2012/0055770 A1 Mar. 8, 2012

(51) Int. Cl.
*H01H 9/00* (2006.01)
*H01H 13/83* (2006.01)

(52) U.S. Cl.
CPC ..... *H01H 13/83* (2013.01); *H01H 2219/044* (2013.01); *H01H 2219/056* (2013.01); *H01H 2219/06* (2013.01); *H01H 2219/062* (2013.01); *H01H 2219/064* (2013.01)

(58) Field of Classification Search
CPC ..... H01H 2205/016; H01H 2219/044; H01H 13/83
USPC ..... 200/310, 520, 5 A
See application file for complete search history.

(56) References Cited

U.S. PATENT DOCUMENTS

| | | | |
|---|---|---|---|
| 4,177,501 | A | 12/1979 | Karlin |
| 7,027,036 | B2 | 4/2006 | Yang |
| 7,064,288 | B2 | 6/2006 | Nam |
| 7,223,005 | B2 | 5/2007 | Lamb et al. |
| 7,364,337 | B2 | 4/2008 | Park |
| 7,608,792 | B1 | 10/2009 | Tsai |
| 7,619,173 | B2 | 11/2009 | Inoue |
| 7,683,279 | B2 | 3/2010 | Kim |
| 7,888,613 | B2 | 2/2011 | Jeffery et al. |
| 7,994,445 | B2 | 8/2011 | Aihara et al. |
| 8,143,541 | B2 | 3/2012 | Tanabe et al. |
| 2007/0057031 | A1 | 3/2007 | Lee |
| 2007/0242048 | A1 | 10/2007 | Yang |
| 2007/0285947 | A1 | 12/2007 | Kim |
| 2008/0179173 | A1 | 7/2008 | Jung et al. |
| 2008/0186736 | A1 | 8/2008 | Rinko |
| 2008/0267572 | A1 | 10/2008 | Sampsell et al. |
| 2009/0122016 | A1 | 5/2009 | Huang |
| 2009/0145733 | A1 | 6/2009 | Tatehata et al. |
| 2009/0173607 | A1 | 7/2009 | Lee et al. |
| 2009/0236210 | A1 | 9/2009 | Clark et al. |

(Continued)

FOREIGN PATENT DOCUMENTS

| | | | |
|---|---|---|---|
| EP | 1729205 | A2 | 12/2006 |
| EP | 1901321 | A2 | 3/2008 |

(Continued)

OTHER PUBLICATIONS

Extended European Search Report (European Application No. 10179232.3) dated Feb. 7, 2011.

(Continued)

*Primary Examiner* — Briggitte R Hammond
(74) *Attorney, Agent, or Firm* — Perry + Currier Inc.

(57) ABSTRACT

A backlighting assembly for use in a keypad assembly. The backlighting assembly includes at least one light emitting source configured to emit light; and a light guide assembly configured to receive the emitted light and direct the light toward the at least one key. The light guide assembly includes both a light guide film and a light guide frame for directing light from the light source toward the key(s).

25 Claims, 8 Drawing Sheets

(56) References Cited

U.S. PATENT DOCUMENTS

| | | | |
|---|---|---|---|
| 2009/0283394 | A1 | 11/2009 | Masuda |
| 2010/0108486 | A1 | 5/2010 | Yoshida |
| 2010/0133083 | A1 | 6/2010 | Watanabe et al. |
| 2010/0148996 | A1 | 6/2010 | Wang |
| 2010/0200381 | A1 | 8/2010 | Kuo |
| 2010/0326803 | A1 | 12/2010 | Um |
| 2011/0079497 | A1 | 4/2011 | Ng et al. |
| 2013/0233688 | A1 | 9/2013 | Chen |

FOREIGN PATENT DOCUMENTS

| | | | |
|---|---|---|---|
| EP | 2031618 | A1 | 3/2009 |
| EP | 2063297 | A1 | 5/2009 |
| EP | 2141716 | A1 | 1/2010 |
| KR | 20060120514 | A | 11/2006 |
| WO | 2007102633 | A1 | 9/2007 |
| WO | 2009157218 | A1 | 12/2009 |

OTHER PUBLICATIONS

Extended European Search Report (European Application No. 10175018.0) dated Feb. 7, 2011.
Web page. Top Bound USA, "Light Guide Film." Available: http://topboundusa.com/keypads.html.
Web page. Shin-Etsu, "Shin-Etsu keypad AP-I type." Available: http://www.shinetsu.co.jp/e/materials/electronics/index.shtml.
Office Action received on co-pending U.S. Appl. No. 12/889,594, dated Jul. 19, 2012.
Web page. Wikipedia, "Blacklight / Light Guide Plate." Available: http://en.wikipedia.org/wiki/Light_guide_plate.
Web page. Electronicstalk, "Light guide film is ideal for backlighting tasks." Available: http://www.electronicstalk.com/news/agi/agi488.html.
Web page. Fujipoly, "Fujipoly Light Guide Film." Available: http://www.fujipoly.co.jp/english/products/other_04/index.htm.
Notice of Allowance and Notice of Allowability as issued on copending U.S. Appl. No. 12/889,594, dated Jan. 9, 2013.
Document relating to Canadian Application No. 2,750,950, dated Mar. 20, 2014 (Office Action).
Document relating to Canadian Application No. 2,750,950, dated May 7, 2014 (Response).
Document relating to European Application No. 0179232.3, dated Oct. 16, 2013 (4th Examination Report).
Document relating to U.S. Appl. No. 13/869,062, dated Oct. 22, 2013 (Notice of Allowance and Notice of Allowability).
Document relating to European Application No. 10179232.3 dated Aug. 13, 2014 (5th Examination Report).
3rd Examination Report ("Communication pursuant to Article 94(3) EPC"). European Application No. 10179232.3, dated Feb. 27, 2013.
"D7". Anonymous: "Light Guide Film (LGF) metal dome array", Internet Article. Dated Sep. 17, 2010. Retrieved from the Internet: URL:http://web.archive.org/web/201009114914/http://www.metal-domes.com/product/dome-array-Lgf.htm[retrieved on Jan. 13, 2012].
Co-pending U.S. Appl. No. 12/889,594, "Backlighting Apparatus for a Keypad Assembly", Filed Sep. 24, 2010.
Document relating to Canadian Application No. 2,750,950, dated Jul. 4, 2013 (Office Action).
Document relating to European Application No. 10175018.0, dated Sep. 12, 2013 (Examination Report).
Examination Report received on Co-pending European Application No. 10179232.3, dated Jan. 18, 2012.
Second Examination Report received on related European Application No. 10179232.3, dated Jun. 19, 2012.
Response as filed on co-pending U.S. Appl. No. 12/889,594, dated Sep. 24, 2012.
Document relating to Canadian Patent Application No. 2,750,950, dated Nov. 24, 2014 (Office Action).

BACKLIGHTING ASSEMBLY FOR A KEYPAD

RELEVANT FIELD

The field of this disclosure relates generally to keypads and keypad backlighting assemblies, with particular but by no means exclusive application to keypads of mobile communications devices.

BACKGROUND

It is often desirable to provide backlighting to the keys of a keypad assembly used in electronic devices such as mobile communications devices in darkened lighting conditions. Light may be emitted from a light source located within the electronic device, and directed toward one or multiple keys, illuminating such key(s).

BRIEF DESCRIPTION OF THE DRAWINGS

Embodiments are described in further detail below, by way of example only, with reference to the accompanying drawings, in which.

DETAILED DESCRIPTION

In one broad aspect, there is provided a keypad assembly. The keypad assembly includes at least one key; at least one light emitting source configured to emit light; and a light guide assembly configured to receive the emitted light and direct the light toward the at least one key. The light guide assembly includes both a light guide film and a light guide frame. The keypad assembly may be configured for use in a mobile device.

In another broad aspect, a backlighting assembly is provided for use within a keypad assembly having at least one key. The backlighting assembly includes: at least one side firing light emitting source configured to emit light; and a light guide assembly configured to receive the emitted light and direct the light toward the at least one key. The light guide assembly includes both a light guide film, and a light guide frame. The keypad assembly may be configured for use in a mobile device.

The light guide film may be configured to receive the emitted light (or light emitted from the light emitting source) and communicate the received light to the light guide frame. In turn, the light guide frame may be configured to direct the communicated light toward the at least one key. Further, the light guide film may be configured to direct the received light toward the at least one key.

In another broad aspect, a method for providing backlighting for a keypad assembly having at least one key is provided. The method includes providing a keypad assembly having at least one light emitting source, wherein the light emitting source is configured to emit light; providing a light guide assembly configured to receive the emitted light and to direct the received light toward the at least one key, wherein the light guide assembly comprises a light guide film and a light guide frame; and causing the light emitting source to emit light.

The light guide film may be configured to receive the emitted light and communicate the received light to the light guide frame. The light guide film may be configured to direct the emitted light toward the at least one key.

Some embodiments of the system and methods described herein make reference to a mobile device. A mobile device may be a two-way communication device with advanced data communication capabilities having the capability to communicate with other computer systems. A mobile device may also include the capability for voice communications. Depending on the functionality provided by a mobile device, it may be referred to as a data messaging device, a two-way pager, a cellular telephone with data messaging capabilities, a wireless Internet appliance, or a data communication device (with or without telephony capabilities), for example. A mobile device may communicate with other devices through a network of transceiver stations.

Figure 1:
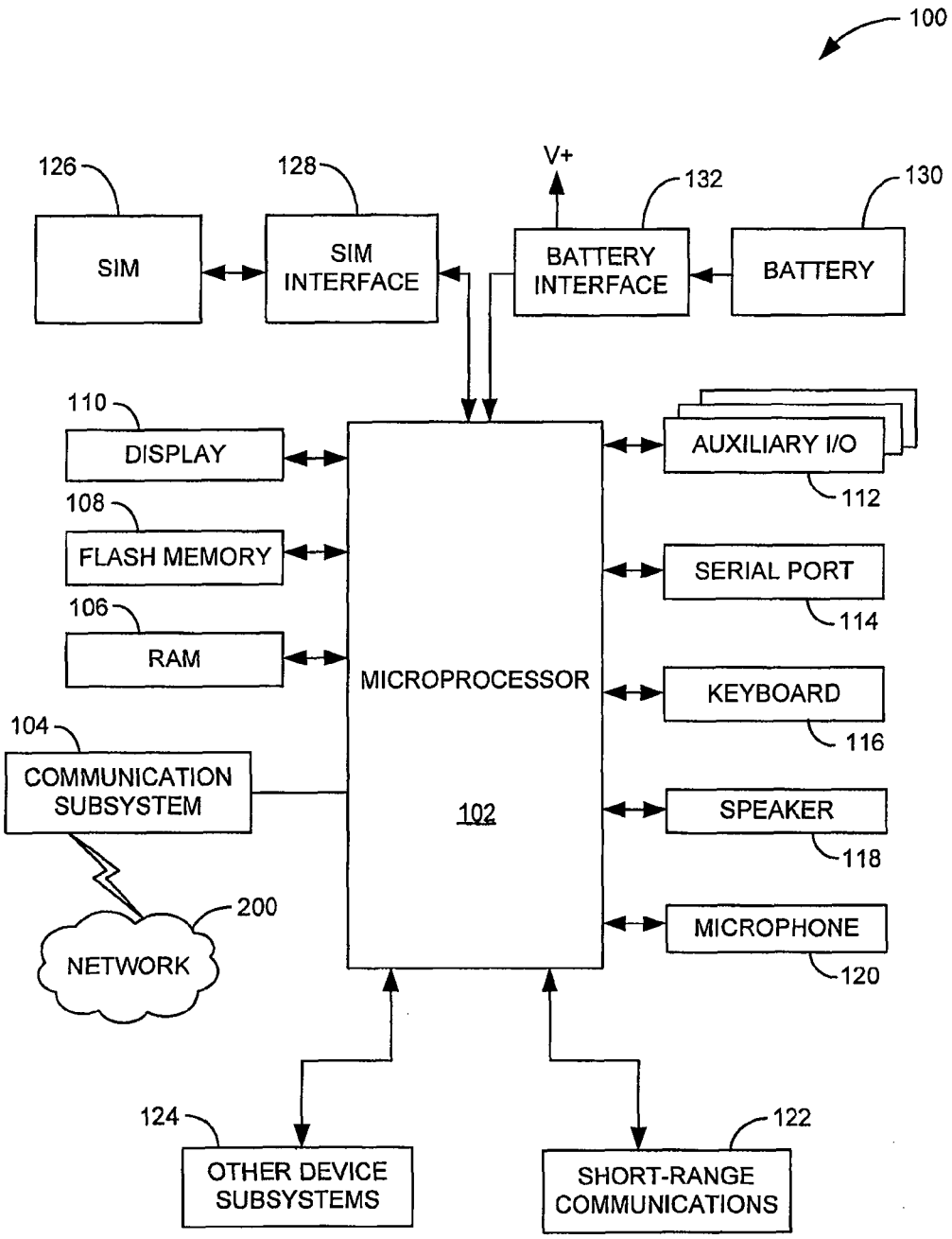
FIG. 1 is a block diagram of a mobile device in one example implementation.
Figure 2:
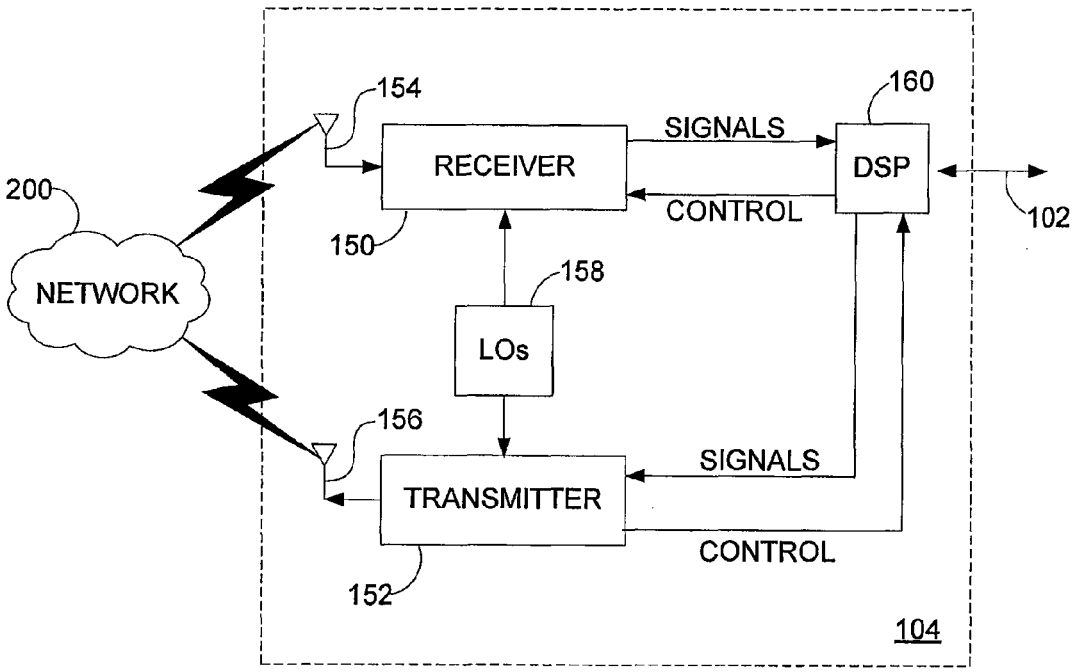
FIG. 2 is a block diagram of a communication subsystem component of the mobile device of FIG. 1.
Figure 3:
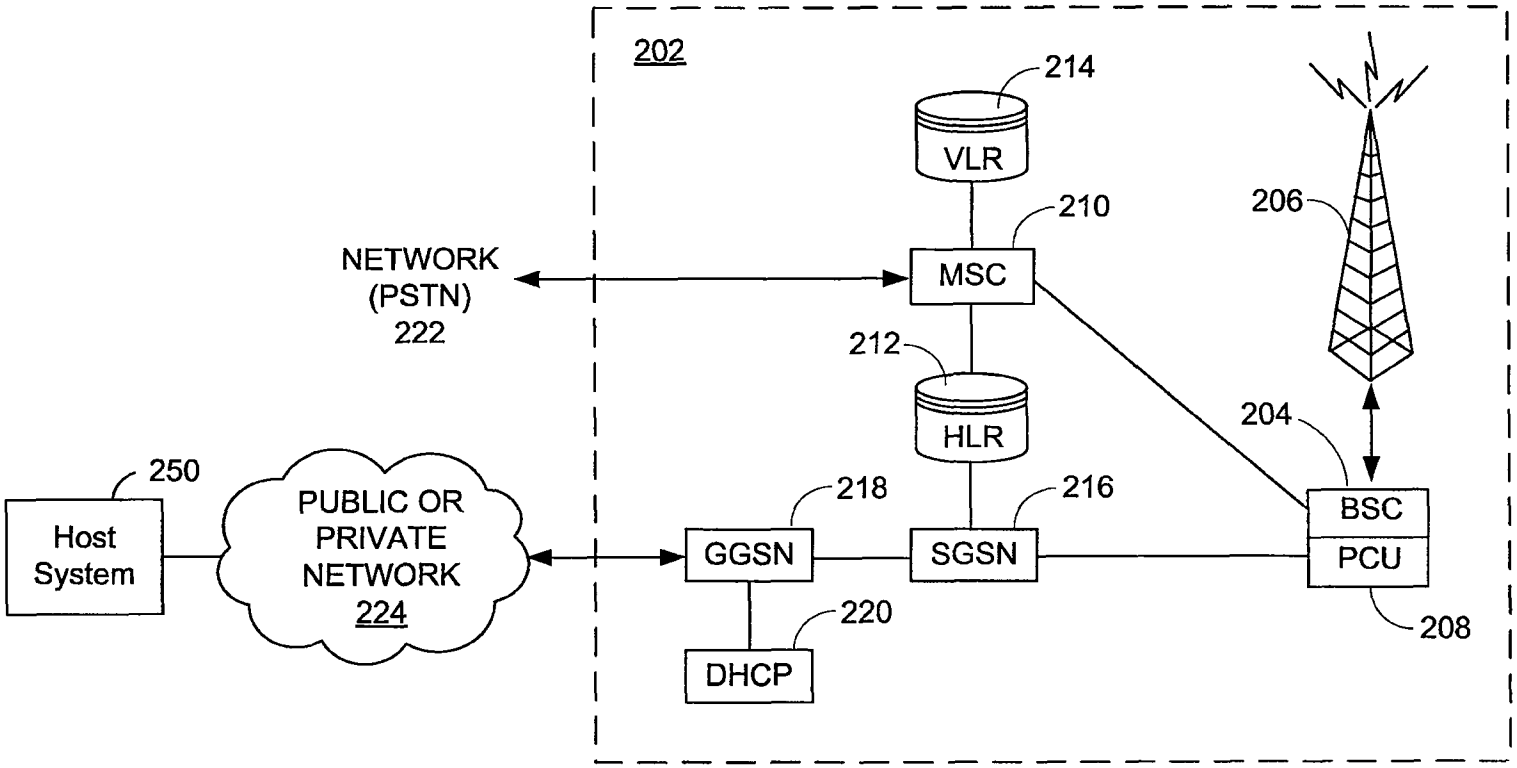
FIG. 3 is a block diagram of a node of a wireless network.

To aid the reader in understanding the structure of a mobile device and how it communicates with other devices, reference is made to FIGS. 1 through 3.

Referring first to FIG. 1, a block diagram of a mobile device in one example implementation is shown generally as 100. Mobile device 100 comprises a number of components, the controlling component being microprocessor 102. Microprocessor 102 controls the overall operation of mobile device 100. Communication functions, including data and voice communications, may be performed through communication subsystem 104. Communication subsystem 104 may be configured to receive messages from and send messages to a wireless network 200. In one example implementation of mobile device 100, communication subsystem 104 may be configured in accordance with the Global System for Mobile Communication (GSM) and General Packet Radio Services (GPRS) standards. The GSM/GPRS wireless network is used worldwide and it is expected that these standards may be supplemented or superseded eventually by Enhanced Data GSM Environment (EDGE) and Universal Mobile Telecommunications Service (UMTS), and Ultra Mobile Broadband (UMB), etc. New standards are still being defined, but it is believed that they will have similarities to the network behaviour described herein, and it will also be understood by persons skilled in the art that the embodiments of the present disclosure are intended to use any other suitable standards that are developed in the future. The wireless link connecting communication subsystem 104 with network 200 represents one or more different Radio Frequency (RF) channels, operating according to defined protocols specified for GSM/GPRS communications. With newer network protocols, these channels are capable of supporting both circuit switched voice communications and packet switched data communications.

Although the wireless network associated with mobile device 100 is a GSM/GPRS wireless network in one example implementation of mobile device 100, other wireless networks may also be associated with mobile device 100 in variant implementations. Different types of wireless networks that may be employed include, for example, data-centric wireless networks, voice-centric wireless networks, and dual-mode networks that can support both voice and data communications over the same physical base stations. Combined dual-mode networks include, but are not limited to, Code Division Multiple Access (CDMA) or CDMA2000 networks, GSM/CPRS networks (as mentioned above), and future third-generation (3G) networks like EDGE and UMTS. Some older examples of data-centric networks include the Mobitex™ Radio Network and the DataTAC™ Radio Network. Examples of older voice-centric data networks include Personal Communication Systems (PCS) networks like GSM and Time Division Multiple Access (TDMA) systems. Other network communication technologies that may be employed include, for example, Integrated Digital Enhanced Network (iDEN™), Evolution-Data Optimized (EV-DO), and High Speed Packet Access (HSPA), etc.

Microprocessor 102 may also interact with additional subsystems such as a Random Access Memory (RAM) 106, flash memory 108, display 110, auxiliary input/output (I/O) subsystem 112, serial port 114, keyboard 116, speaker 118, microphone 120, short-range communications subsystem 122 and other device subsystems 124.

Some of the subsystems of mobile device 100 perform communication-related functions, whereas other subsystems may provide "resident" or on-device functions. By way of example, display 110 and keyboard 116 may be used for both communication-related functions, such as entering a text message for transmission over network 200, as well as device-resident functions such as a calculator or task list. Operating system software used by microprocessor 102 is typically stored in a persistent store such as flash memory 108, which may alternatively be a read-only memory (ROM) or similar storage element (not shown). Those skilled in the art will appreciate that the operating system, specific device applications, or parts thereof, may be temporarily loaded into a volatile store such as RAM 106.

Mobile device 100 may send and receive communication signals over network 200 after network registration or activation procedures have been completed. Network access may be associated with a subscriber or user of a mobile device 100. To identify a subscriber, mobile device 100 may provide for a Subscriber Identity Module ("SIM") card 126 to be inserted in a SIM interface 128 in order to communicate with a network. SIM 126 may be one example type of a conventional "smart card" used to identify a subscriber of mobile device 100 and to personalize the mobile device 100, among other things. Without SIM 126, mobile device 100 may not be fully operational for communication with network 200. By inserting SIM 126 into SIM interface 128, a subscriber may access all subscribed services. Services may include, without limitation: web browsing and messaging such as e-mail, voice mail, Short Message Service (SMS), and Multimedia Messaging Services (MMS). More advanced services may include, without limitation: point of sale, field service and sales force automation. SIM 126 may include a processor and memory for storing information. Once SIM 126 is inserted in SIM interface 128, it may be coupled to microprocessor 102. In order to identify the subscriber, SIM 126 may contain some user parameters such as an International Mobile Subscriber Identity (IMSI). By using SIM 126, a subscriber may not necessarily be bound by any single physical mobile device. SIM 126 may store additional subscriber information for a mobile device as well, including datebook (or calendar) information and recent call information.

Mobile device 100 may be a battery-powered device and may comprise a battery interface 132 for receiving one or more rechargeable batteries 130. Battery interface 132 may be coupled to a regulator (not shown), which assists battery 130 in providing power V+ to mobile device 100. Although current technology makes use of a battery, future technologies such as micro fuel cells may provide power to mobile device 100. In some embodiments, mobile device 100 may be solar-powered.

Microprocessor 102, in addition to its operating system functions, enables execution of software applications on mobile device 100. A set of applications that control basic device operations, including data and voice communication applications, may be installed on mobile device 100 during its manufacture. Another application that may be loaded onto mobile device 100 is a personal information manager (PIM). A PIM has functionality to organize and manage data items of interest to a subscriber, such as, but not limited to, e-mail, calendar events, voice mails, appointments, and task items. A PIM application has the ability to send and receive data items via wireless network 200. PIM data items may be seamlessly integrated, synchronized, and updated via wireless network 200 with the mobile device subscriber's corresponding data items stored and/or associated with a host computer system. This functionality may create a mirrored host computer on mobile device 100 with respect to such items. This can be particularly advantageous where the host computer system is the mobile device subscriber's office computer system.

Additional applications may also be loaded onto mobile device 100 through network 200, auxiliary I/O subsystem 112, serial port 114, short-range communications subsystem 122, or any other suitable subsystem 124. This flexibility in application installation increases the functionality of mobile device 100 and may provide enhanced on-device functions, communication-related functions, or both. For example, secure communication applications may enable electronic commerce functions and other such financial transactions to be performed using mobile device 100.

Serial port 114 enables a subscriber to set preferences through an external device or software application and extends the capabilities of mobile device 100 by providing for information or software downloads to mobile device 100 other than through a wireless communication network. The alternate download path may, for example, be used to load an encryption key onto mobile device 100 through a direct and thus reliable and trusted connection to provide secure device communication.

Short-range communications subsystem 122 provides for communication between mobile device 100 and different systems or devices, without the use of network 200. For example, subsystem 122 may include an infrared device and associated circuits and components for short-range communication. Examples of short range communication include standards developed by the Infrared Data Association (IrDA), Bluetooth®, and the 802.11 family of standards (WI-Fi®) developed by IEEE.

In use, a received signal such as a text message, an e-mail message, or web page download is processed by communication subsystem 104 and input to microprocessor 102. Microprocessor 102 then processes the received signal for output to display 110 or alternatively to auxiliary I/O subsystem 112. A subscriber may also compose data items, such as e-mail messages, for example, using keyboard 116 in conjunction with display 110 and possibly auxiliary I/O subsystem 112. Auxiliary subsystem 112 may include devices such as: a touch screen, mouse, track ball, optical trackpad, infrared fingerprint detector, or a roller wheel with dynamic button pressing capability. Keyboard 116 may comprise an alphanumeric keyboard and/or telephone-type keypad, for example. A composed item may be transmitted over network 200 through communication subsystem 104.

For voice communications, the overall operation of mobile device 100 may be substantially similar, except that the received signals may be processed and output to speaker 118, and signals for transmission may be generated by microphone 120. Alternative voice or audio I/O subsystems, such as a voice message recording subsystem, may also be implemented on mobile device 100. Although voice or audio signal output is accomplished primarily through speaker 118, display 110 may also be used to provide additional information such as the identity of a calling party, duration of a voice call, or other voice call related information.

Referring now to FIG. 2, a block diagram of the communication subsystem component 104 of FIG. 1 is shown. Communication subsystem 104 may comprise a receiver 150, a transmitter 152, one or more embedded or internal antenna elements 154, 156, Local Oscillators (LOs) 158, and a processing module such as a Digital Signal Processor (DSP) 160.

The particular design of communication subsystem 104 is dependent upon the network 200 in which mobile device 100 is intended to operate; thus, it should be understood that the design illustrated in FIG. 2 serves only as one example. Signals received by antenna 154 through network 200 are input to receiver 150, which may perform such common receiver functions as signal amplification, frequency down conversion, filtering, channel selection, and analog-to-digital (A/D) conversion. ND conversion of a received signal allows more complex communication functions such as demodulation and decoding to be performed in DSP 160. In a similar manner, signals to be transmitted are processed, including modulation and encoding, by DSP 160. These DSP-processed signals are input to transmitter 152 for digital-to-analog (D/A) conversion, frequency up conversion, filtering, amplification and transmission over network 200 via antenna 156. DSP 160 not only processes communication signals, but also provides for receiver and transmitter control. For example, the gains applied to communication signals in receiver 150 and transmitter 152 may be adaptively controlled through automatic gain control algorithms implemented in DSP 160.

The wireless link between mobile device 100 and a network 200 may contain one or more different channels, typically different RF channels, and associated protocols used between mobile device 100 and network 200. A RF channel is generally a limited resource, typically due to limits in overall bandwidth and limited battery power of mobile device 100.

When mobile device 100 is fully operational, transmitter 152 may be typically keyed or turned on only when it is sending to network 200 and may otherwise be turned off to conserve resources. Similarly, receiver 150 may be periodically turned off to conserve power until it is needed to receive signals or information (if at all) during designated time periods.

Referring now to FIG. 3, a block diagram of a node of a wireless network is shown as 202. In practice, network 200 comprises one or more nodes 202. Mobile device 100 communicates with a node 202 within wireless network 200. In the example implementation of FIG. 3, node 202 is configured in accordance with GPRS and GSM technologies; however, in other embodiments, different standards may be implemented as discussed in more detail above. Node 202 includes a base station controller (BSC) 204 with an associated tower station 206, a Packet Control Unit (PCU) 208 added for GPRS support in GSM, a Mobile Switching Center (MSC) 210, a Home Location Register (HLR) 212, a Visitor Location Registry (VLR) 214, a Serving GPRS Support Node (SGSN) 216, a Gateway GPRS Support Node (GGSN) 218, and a Dynamic Host Configuration Protocol (DHCP) server 220. This list of components is not meant to be an exhaustive list of the components of every node 202 within a GSM/GPRS network, but rather a list of components that are commonly used in communications through network 200.

In a GSM network, MSC 210 is coupled to BSC 204 and to a landline network, such as a Public Switched Telephone Network (PSTN) 222 to satisfy circuit switched requirements. The connection through PCU 208, SGSN 216 and GGSN 218 to the public or private network (Internet) 224 (also referred to herein generally as a shared network infrastructure) represents the data path for GPRS capable mobile devices. In a GSM network extended with GPRS capabilities, BSC 204 also contains a Packet Control Unit (PCU) 208 that connects to SGSN 216 to control segmentation, radio channel allocation and to satisfy packet switched requirements. To track mobile device location and availability for both circuit switched and packet switched management, HLR 212 is shared between MSC 210 and SGSN 216. Access to VLR 214 is controlled by MSC 210.

Station 206 may be a fixed transceiver station. Station 206 and BSC 204 together may form the fixed transceiver equipment. The fixed transceiver equipment provides wireless network coverage for a particular coverage area commonly referred to as a "cell". The fixed transceiver equipment transmits communication signals to and receives communication signals from mobile devices within its cell via station 206. The fixed transceiver equipment normally performs such functions as modulation and possibly encoding and/or encryption of signals to be transmitted to the mobile device in accordance with particular, usually predetermined, communication protocols and parameters, under control of its controller. The fixed transceiver equipment similarly demodulates and possibly decodes and decrypts, if necessary, any communication signals received from mobile device 100 within its cell. Communication protocols and parameters may vary between different nodes. For example, one node may employ a different modulation scheme and operate at different frequencies than other nodes.

For all mobile devices 100 registered with a specific network, permanent configuration data such as a user profile may be stored in HLR 212. HLR 212 may also contain location information for each registered mobile device and can be queried to determine the current location of a mobile device. MSC 210 is responsible for a group of location areas and stores the data of the mobile devices currently in its area of responsibility in VLR 214. Further VLR 214 also contains information on mobile devices that are visiting other networks. The information in VLR 214 includes part of the permanent mobile device data transmitted from HLR 212 to VLR 214 for faster access. By moving additional information from a remote HLR 212 node to VLR 214, the amount of traffic between these nodes can be reduced so that voice and data services can be provided with faster response times while requiring less use of computing resources.

SGSN 216 and GGSN 218 are elements that may be added for GPRS support; namely packet switched data support, within GSM. SGSN 216 and MSC 210 have similar responsibilities within wireless network 200 by keeping track of the location of each mobile device 100. SGSN 216 also performs security functions and access control for data traffic on network 200. GGSN 218 provides internetworking connections with external packet switched networks and connects to one or more SGSNs 216 via an Internet Protocol (IP) backbone network operated within the network 200. During normal operations, a given mobile device 100 performs a "GPRS Attach" to acquire an IP address and to access data services. This normally is not present in circuit switched voice channels as Integrated Services Digital Network (ISDN)

addresses may be generally used for routing incoming and outgoing calls. Currently, GPRS capable networks may use private, dynamically assigned IP addresses, thus requiring a DHCP server 220 connected to the GGSN 218. There are many mechanisms for dynamic IP assignment, including using a combination of a Remote Authentication Dial-In User Service (RADIUS) server and DHCP server, for example. Once the GPRS Attach is complete, a logical connection is established from a mobile device 100, through PCU 208, and SGSN 216 to an Access Point Node (APN) within GGSN 218, for example. The APN represents a logical end of an IP tunnel that can either access direct Internet compatible services or private network connections. The APN also represents a security mechanism for network 200, insofar as each mobile device 100 must be assigned to one or more APNs and mobile devices 100 cannot generally exchange data without first performing a GPRS Attach to an APN that it has been authorized to use. The APN may be considered to be similar to an Internet domain name such as "myconnection.wireless-.com".

Once the GPRS Attach is complete, a tunnel is created and all traffic is exchanged within standard IP packets using any protocol that can be supported in IP packets. This includes tunneling methods such as IP over IP as in the case with some IPSecurity (IPsec) connections used with Virtual Private Networks (VPN). These tunnels are also referred to as Packet Data Protocol (PDP) Contexts and there are a limited number of these available in the network 200. To maximize use of the PDP Contexts, network 200 will run an idle timer for each PDP Context to determine if there is a lack of activity. When a mobile device 100 is not using its PDP Context, the PDP Context can be deallocated and the IP address returned to the IP address pool managed by DHCP server 220.

Figure 4:
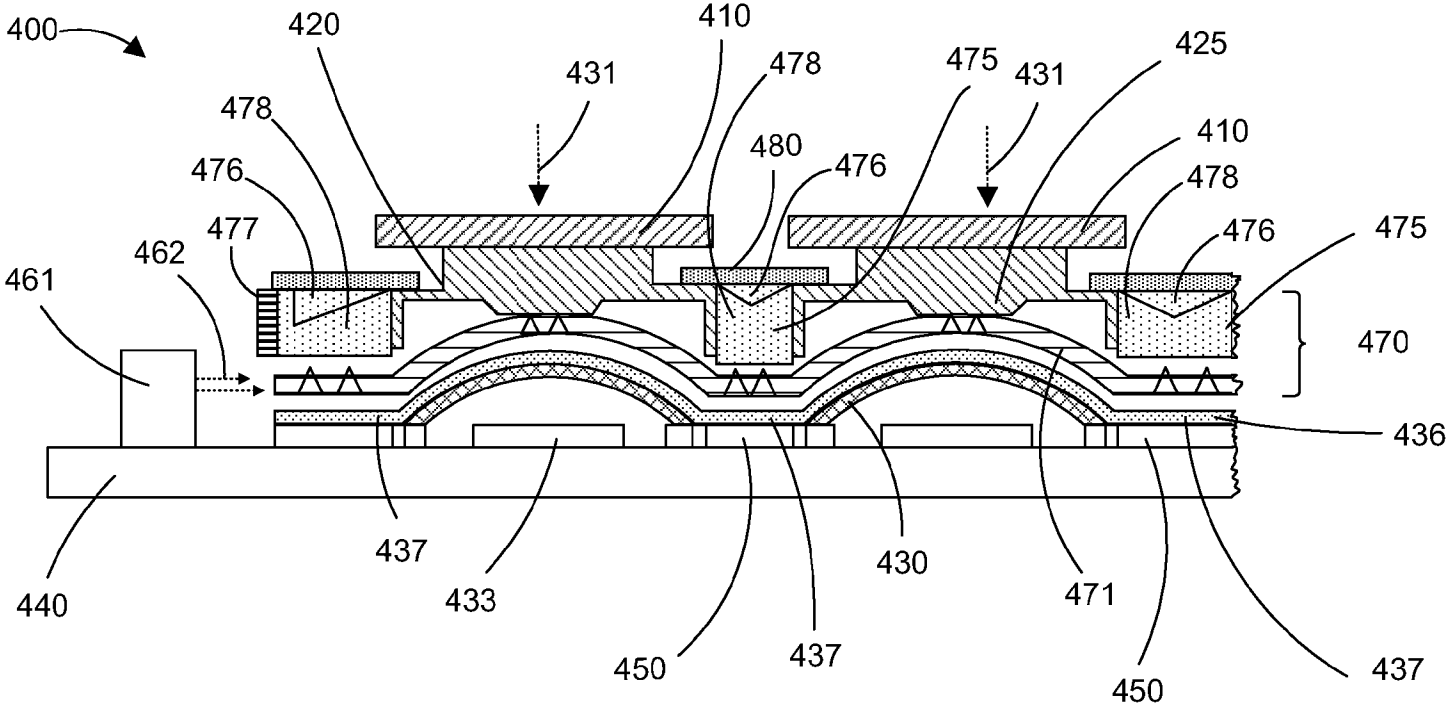
FIG. 4 is a section view of a portion of a keypad assembly according to an embodiment of the present disclosure.

Referring now to FIG. 4, a keypad assembly according to an embodiment of the present invention is shown generally as 400. The keypad assembly 400 may be used within electronic devices, such as within the keyboard 116 of the mobile device 100 described above. The keypad assembly 400 includes keys (or keycaps) 410 positioned within a flexible deflection web 420. The keys 410 are positioned atop, and operatively coupled to, corresponding actuator portions 425 of the deflection web 420. The keys 410 may be adhered to the actuators 425 or, alternatively, the keys 410 and actuators 425 may be provided with complementary male and female features to permit the keys 410 to sit within the actuators 425.

Within the keypad assembly 400, each key 410 and actuator 425 correspond to, and are aligned with, a dome 430 (which may be made of metal) and a switch sensor 433 coupled to a base 440 of the keypad assembly 400. Each key 410 is operatively coupled to its corresponding dome 430. When a key 410 is depressed (i.e. in the key press direction 431), the corresponding metal dome 430 collapses and engages the corresponding sensor switch 433. Accordingly, engagement of a sensor switch 433 produces a signal that a corresponding key 410 has been depressed. Those of ordinary skill in the art will appreciate the metal domes 430 and sensor switches 433 operate like dome switches commonly used in the field.

Optionally, and as illustrated in FIG. 4, a dome overlay 436 may be provided within the keypad assembly 400 in order to restrict lateral movement of the domes 430 within the assembly 400. The portions 437 of the dome overlay 436 not in contact with a dome 430 maybe operatively coupled to the base 440 via coupling elements 450, in order to localize the domes between the portions 437 of the dome overlay 436. The coupling elements 450 may comprise, for example, an adhesive or alternatively, a spacer having adhesive tape on either side. The spacer may comprise a material with favorable sealing characteristics, in order to prevent dust and/or water from contaminating the dome and switch area within the keypad assembly 400.

The keypad assembly 400 is also provided with a light emitting source 461 and a light guide assembly 470. When installed within the keypad assembly 400, the light emitting source 461 and light guide assembly 470 are appropriately positioned with respect to one another such that emitted light 462 from the light emitting source (or light source) 461 is received by the light guide assembly 470. Further, the light guide assembly 470 is configured to direct light it receives from the light emitting source 461 towards the keys 410 of the keypad assembly 400. The light guide assembly 470 will be discussed in greater detail below.

The light emitting source (or light source) 461 may comprise a commercially available side firing (or side emitting) light emitting diode (LED). As ordinarily skilled persons will appreciate, a side firing LED typically comprises a housing for the LED that is mountable at a base of the housing and an LED configured to emit light from a side wall—adjacent the base—of the housing. In contrast, the housing of a top firing LED, which is also mountable at its base, contains an LED configured to emit light from a top surface—opposite the base—of the housing.

Ordinarily skilled persons will appreciate that LEDs typically require there to be a certain amount of clearance (or space) between the surface of the LED, from which the light is emitted, and a light guide or other object in order for the LEDs to function efficiently. This space is typically referred as the LED leading space gap. When using "side" firing LEDs (i.e. LEDs which emit light laterally to their base), as opposed to "top" firing LEDs (i.e. LEDs which emit light in a direction to their base) as the light emitting source 461 within a keypad assembly 400, any required leading space gap is lateral (i.e. generally perpendicular to the key press direction 431) rather than vertical (i.e. generally parallel to the key press direction 431). Consequently, the thickness of the keypad assembly 400 may be reduced by using side firing LEDs instead of top firing LEDs as the light source 461 within a keypad assembly 400.

Figure 5:
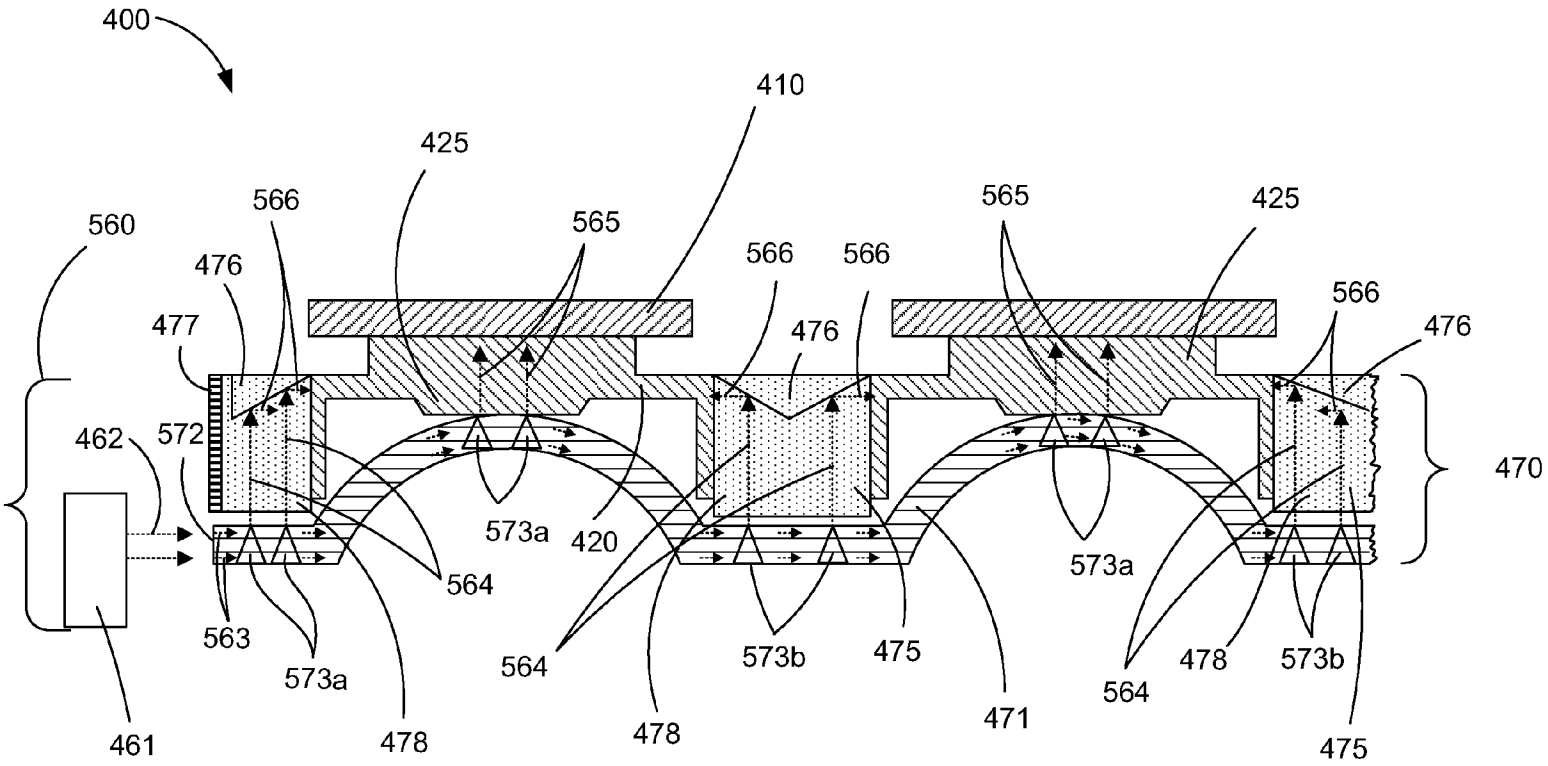
FIG. 5 is a section view of selected elements of the keypad assembly of FIG. 4.

With reference to FIG. 5, the configuration of an example light guide assembly 470 is described in greater detail. FIG. 5 illustrates an enlargement of a selected number of components—namely, the light guide assembly 470, the light source 461, the deflection web 420, and the keys 410—of the embodiment of the keypad assembly 400 shown in FIG. 4, in isolation. Despite some of the components of the keypad assembly 400 being absent, the elements included in FIG. 5 are illustrated having an operative relationship with one another that they would have when installed within the keypad assembly 400. For the purposes of this disclosure, the light emitting source 461 and the light guide assembly 470 collectively make up a backlighting assembly 560 as referred to herein.

The light guide assembly 470 comprises a light guide film 471 and a light guide frame 475. An edge 572 of the light guide film 471 is positioned adjacent the light source 461 such that light 462 emitted from the light source 461 is received by the light guide film 471 through its edge 572. For the purposes of this disclosure, once light emitted from the light source 461 (emitted light 462) enters the light guide film 471, it is referred to as received light 563. As those skilled in the art will appreciate, the light guide film 471, absent any light directing features, is configured to contain a substantial portion of the received light 563 as it travels through the film.

The light guide film 471 may be provided with several micro features 573*a*, 573*b* configured to emit received light 563 out from the light guide film 471. Those of ordinary skill in the art will appreciate that the micro features 573*a*, 573*b* have been illustrated schematically. In some embodiments, one or more micro features 573*a*, 573*b* may be provided at predetermined locations of the light guide film 471 so as to align with the keys 410 of the keypad assembly 400 when the light guide film 471 is positioned within the assembly 400. In some embodiments—e.g. where a dome overlay 436 (FIG. 4) is provided within the keypad assembly 400, and the light guide film 471 is configured to conform substantially with the shape of the dome overlay 436—the micro features 573*a* may be located near the apex of domes formed in the light guide film 471.

When received light 563 traveling through the light guide film 471 intersects with a micro feature 573*a*, a portion of the light 563 is directed toward the key 410 in alignment with that micro feature 573*a*. For the purposes of this disclosure, received light 563 directed by micro features 573*a* (in line with the key(s) 410) from the light guide film 471 toward the key(s) 410 is referred to as primary directed light 565. The primary directed light 565 may serve as the primary source of backlighting for the key(s) 410 of the keypad assembly 400.

It may be desirable for the deflection web 420 to be made from a substantially translucent (or semitransparent) material to ensure that a relatively high portion of the primary directed light 565 is able to pass through the deflection web 420 (including the actuators 425) and reach the key(s) 410.

One or more micro features 573*b* may also be provided at predetermined locations of the light guide film 471 so as to align with the light guide frame 475, when the two light guide components (film and frame) are in their installed positions within the keypad assembly 400. When received light 563 meets a micro feature 573*b*, a portion of the received light 563 is communicated to the light guide frame 475. For the purposes of this disclosure, received light 563 communicated from the light guide film 471 to the light guide frame 475 is referred to as communicated light 564. As will be discussed in greater detail below, the light guide frame 475 may then direct the communicated light 564 toward the keys 410.

The micro features 573*a*, 573*b* provided in the light guide film 471 may comprise one or more cavities etched into a surface of the film. The cavities may, for example, comprise v-shaped cuts, or white printing dots (or micro dots). A plurality of micro features 573*a*, 573*b* may form a two dimensional array on the light guide film's 471 surface that helps to emit received light 563 from the light guide film 471 evenly. Those of ordinary skill in the art will appreciate that these and/or other known micro optical features may be provided to the light guide film 471 to direct light therefrom.

Figure 6:
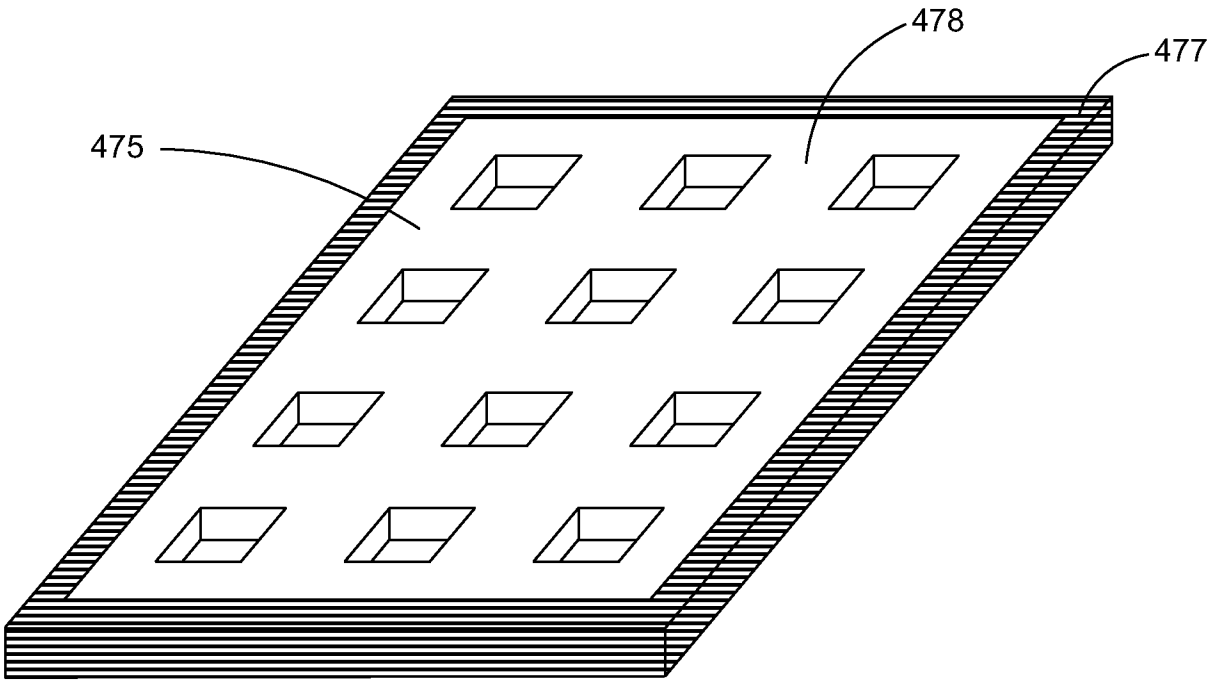
FIG. 6 is a perspective view of an example light guide frame according to the present disclosure.

Referring now jointly to FIGS. 5 and 6, the configuration of the light guide frame 475 is discussed in greater detail. FIG. 6 shows a perspective view of a light guide frame 475 according to an embodiment of the present disclosure, and is illustrative of the exterior structure of the frame 475. The example light guide frame 475 shown is for use with a standard alphanumeric twelve-key keypad assembly (0-9, #, *). Those of ordinary skill in the art will appreciate that other configurations of frame 475 may also exist to correspond to keypad assemblies with different numbers of and arrangements of keys, e.g. a full QWERTY keypad assembly.

In some embodiments, the light guide frame 475 may be manufactured as a two-shot injection molded part. The first shot 478 may be made of a material with a relatively high transmittance in the visible light spectrum (e.g. a clear resin) in order to afford the frame 475 light transferring capabilities; and, the second shot 477 may be of a substantially reflective material (e.g. a black, or opaque white resin) for preventing light from leaking out.

The light guide frame 475 may be configured to direct the communicated light 564 (from the light guide film 471) toward one or several keys 410. For the purposes of this disclosure, communicated light 564 directed toward the key(s) 410 by the light guide frame 475 is referred to as secondary directed light 566. In order to appropriately direct the communicated light 564, the light guide frame 475 may be provided with one or more directional elements 476. As was the case with the micro features 573*a*, 573*b*, directional elements 476 have been illustrated schematically. Those of ordinary skill in the art will appreciate that the directional elements 476 may not be representative of the actual characteristics of such elements, physical or otherwise.

Where the light guide frame 475 is manufactured as a two-shot injection molded part (as discussed above), the directional elements 476 may be provided in the material of the first shot 478. The directional features 476 may comprise resin blocks with sloped surfaces which act to redirect some or all of the communicated light 564 toward the key(s) 410. In some variants, the directional elements 476 may be provided in the mold before the first shot 478 is injected.

As the secondary directed light 566 may be required to travel through a deflection web 420 to reach the key(s) 410, the deflection web 420, as discussed above, may comprise a substantially translucent (or semitransparent) material to help ensure that a relatively large portion of the secondary directed light 566 reaches the key(s) 410.

The light guide frame 475 may be made of one or more substantially rigid materials. In embodiments where a deflection web 420 is provided within the keypad assembly 400, the light guide frame 475 and the deflection web 420 may be co-molded. As a result, the light guide frame 475 may provide structural support for the deflection web 420. The structural support afforded to the deflection web 420 by the light guide frame 475 may effectively isolate each key 410 and corresponding elements (i.e. dome 430 and in some cases actuator portion 425 of the deflection web 420) from the depression of adjacent keys 410. In other words, a light guide frame 475 with substantial rigidity, co-molded to a deflection web 420 may substantially prevent movement of one portion of the deflection web 420 (corresponding to a key 410) from translating to any of the other portions of the deflection web 420 (corresponding to any of the other keys 410). This mechanical isolation of each actuator portion 425 of the deflection web 420 may lead to a better tactile feel to a user of the keypad assembly 400.

In some embodiments, the light guide frame 475 may be provided with location pins (not shown), and the light guide film 471 may be provided with location pin holes (not shown). To help achieve greater and more sustainable alignment of the light guide frame 475 with respect to the light guide film 471, the location pins (not shown) of the frame 475 may be slotted through the location pin holes (not shown) of the film 471 when the two light guide components are installed within the keypad assembly 400.

Figure 7:
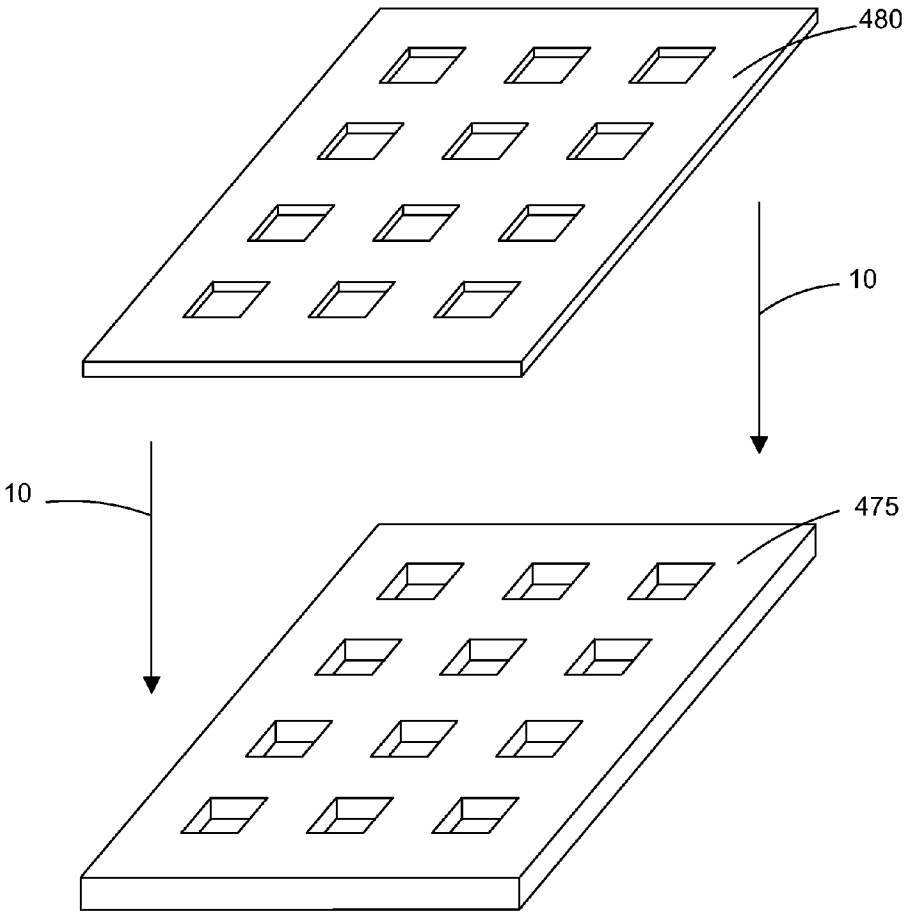
FIG. 7 is an exploded perspective view of the light guide frame of FIG. 6 to which an example light shielding layer is overlaid.

In some embodiments, a light shielding layer 480 may be provided atop the light guide frame 475 in order to help prevent light from escaping the light guide frame 475 in undesired areas. In some embodiments, the light shielding layer 480 may be made of polyethylene terephthalate colored black with white painting on the surface which faces the light guide frame 475. FIG. 7 illustrates an example light shielding layer 480 that may be overlaid onto the light guide frame 475 in the direction of arrows 10. The light shielding layer 480 may be attached to the "top" surface of the light guide frame 475 using an adhesive.

Figure 8:
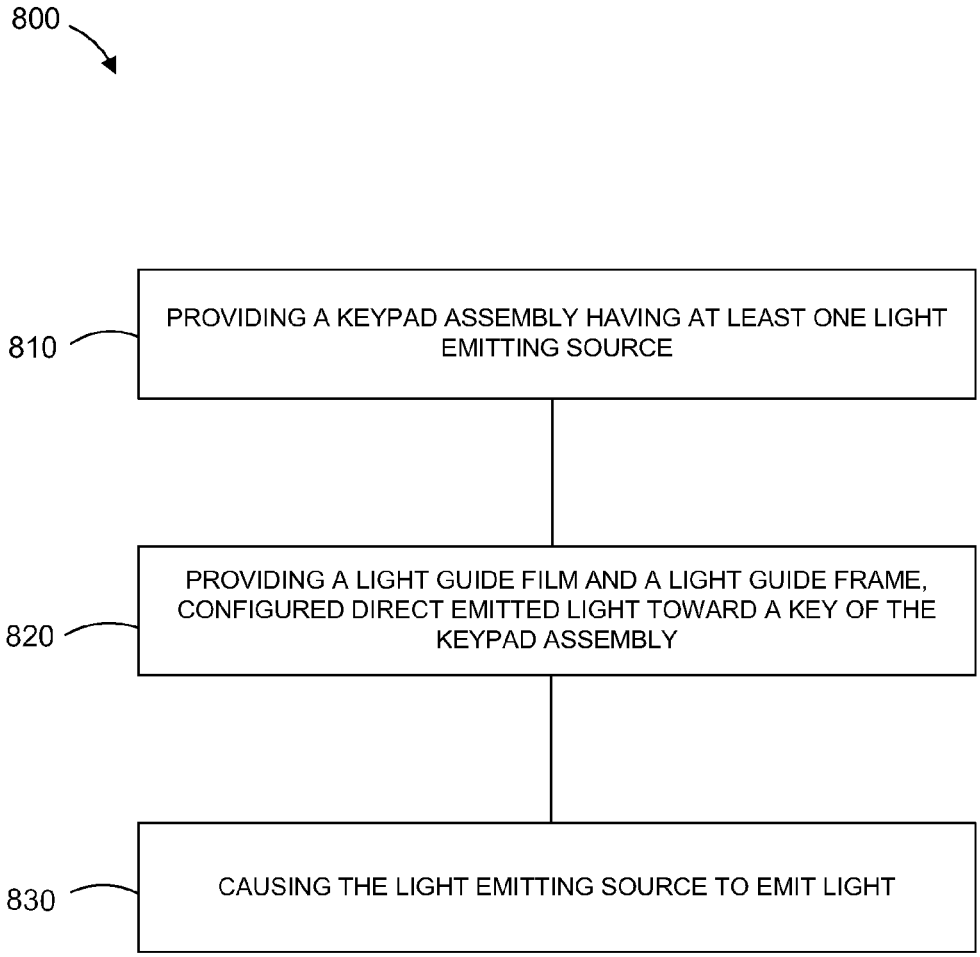
FIG. 8 is a logical flow diagram of a method for providing backlighting for a keypad assembly according to the present disclosure.

Referring now to the logical flow diagram of FIG. 8, a method for providing backlighting for a keypad assembly 400 having at least one key 410 (the method referred to generally as 800) will now be discussed. A keypad assembly 400 having at least one light emitting source 461, configured to emit light, is provided at Block 810.

At Block 820, a light guide assembly 470, comprising both a light guide film 471 and a light guide frame 475, is provided for use within the keypad assembly 400. The light guide assembly 470 may be configured within the keypad assembly 400 so as to receive light emitted (or emitted light 462) from the light source(s) 461 toward the key(s) 410 of the keypad assembly 400. As discussed above, a suitable configuration may be achieved by aligning an edge 572 of the light guide film 471 with the light emitted from the light emitting source 461, and appropriately aligning the light guide frame 475 with the light guide film 471. Also as discussed above, when the light guide frame 475 is appropriately aligned with the light guide film 471, the two light guide components 471, 475 may cooperate to direct light 462 emitted from the light source 461 toward the key(s) 410 of the keypad assembly 400 via micro features 573*a*, 573*b* and directional elements 476 in the light guide film 471 and light guide frame 475, respectively.

At Block 830, the at least one light emitting source 461 is caused to emit light. The emitted light 462 enters the light guide film 471 as received light 563 which is then directed from the light guide film 471 toward the key(s) 410, or communicated from the light guide film 471 to the light guide frame 475 and subsequently directed toward the key(s) 410 by the light guide frame 475.

The various embodiments of keypad assemblies 400 and backlighting assemblies 560 described herein incorporate light guide assemblies 470 having both a light guide film 471 and a light guide frame 475. The thickness of a keypad assembly 400 (and therefore the electronic device incorporating the keypad assembly 400) may be reduced by using a side firing LED and eliminating the need to accommodate the leading space gap typically required of top firing light sources. Commonly, side firing light sources are used in conjunction with light guide films 471, as opposed to light guide frames 475. Supplementing the light guiding capabilities of the light guide film 471 with those of a light guide frame 475 may allow for the use of a thinner light guide film 471, potentially resulting in a thinner keypad assembly 400. Further, the use of the light guide frame 475 may provide structural support to a deflection web 420 of a keypad assembly 400, which may effectively isolate the keys 410 from one another, and in turn, result in a greater tactile feel to a user of the keypad assembly 400.

The steps of a method in accordance with any of the embodiments described herein may not be required to be performed in any particular order, whether or not such steps are described in the claims or otherwise in numbered or lettered paragraphs.

The keypad assembly and backlighting assembly have been described with regard to a number of embodiments. However, it will be understood by persons skilled in the art that other variants and modifications may be made without departing from the scope of the disclosure as defined in the claims appended hereto.

The invention claimed is:

1. A keypad assembly comprising:
(a) at least one key;
(b) a deflection web comprising at least one actuator corresponding to the at least one key;
(c) at least one light emitting source configured to emit light;
(d) a light guide assembly configured to receive the emitted light and direct the light toward the at least one key; and
(e) wherein the light guide assembly comprises:
(i) a light guide film, and
(ii) a substantially rigid frame to guide light and to provide structural support.

2. The keypad assembly of claim 1, wherein the light guide film is configured to direct the received light toward the at least one key.

3. The keypad assembly of claim 1, wherein the frame is further configured to provide structural support to the deflection web.

4. The keypad assembly of claim 1 , wherein the frame is co-molded with the deflection web.

5. The keypad assembly of claim 1, wherein the light guide film comprises a material having a high transmittance to visible light.

6. The keypad assembly of claim 1, wherein the light guide frame is configured to receive the light and communicate the received light toward the at least one key.

7. The keypad assembly of claim 1, wherein the light guide frame comprises a material having a high transmittance to visible light.

8. The keypad assembly of claim 1, wherein the light guide film is configured to receive the emitted light and communicate the received light to the light guide frame.

9. The keypad assembly of claim 8, wherein the light guide film comprises at least one micro feature configured for directing light toward the light guide frame.

10. The keypad assembly of claim 9, wherein the at least one micro feature comprises an etched cavity.

11. The keypad assembly of claim 1, further comprising at least one metal dome configured for operable engagement by the at least one key, and a dome overlay between the key and the metal dome.

12. The keypad assembly of claim 11, wherein the shape of the light guide film substantially conforms to the shape of the dome overlay.

13. A backlighting assembly for a keypad assembly having at least one key, the backlighting assembly comprising:
(a) a deflection web comprising at least one actuator corresponding to the at least one key;
(b) at least one side firing light emitting source configured to emit light;
(c) a light guide assembly configured to receive the emitted light and direct the light toward the at least one key; and
(d) wherein the light guide assembly comprises:
(i) a light guide film, and
(ii) a substantially rigid light guide frame.

14. The backlighting assembly of claim 13, wherein the light guide film is configured to direct the received light toward the at least one key.

15. The backlighting assembly of claim 13, wherein the at least one side firing light emitting source comprises a light emitting diode.

16. The backlighting assembly of claim 13, wherein the assembly is configured for use in a mobile device.

17. The backlighting assembly of claim 13, wherein the light guide film is configured to receive the emitted light and communicate the received light to the light guide frame.

18. The backlighting assembly of claim 17, wherein the light guide frame is configured to direct the communicated light toward the at least one key.

19. A method for providing backlighting for a keypad assembly having at least one key, the method comprising:

(a) providing a keypad assembly having at least one light emitting source, wherein the light emitting source is configured to emit light, the keypad assembly further having a deflection web comprising at least one actuator corresponding to the at least one key;

(b) providing a light guide assembly configured to receive the emitted light and to direct the received light toward the at least one key, wherein the light guide assembly comprises a light guide film and a substantially rigid light guide frame; and (c) causing the light emitting source to emit light.

20. The method of claim 19, wherein the light guide film is configured to receive the emitted light and communicate the received light to the light guide frame.

21. The method of claim 19, wherein the light guide film is configured to direct the emitted light toward the at least one key.

22. A keypad assembly comprising:

at least one key;

at least one light emitting source configured to emit light;

a light guide assembly configured to receive the emitted light and direct the light toward the at least one key;

a deflection web comprising at least one actuator corresponding to the at least one key;

wherein the light guide assembly comprises:

a light guide film, and a substantially rigid light guide frame;

wherein the light guide frame is configured to provide structural support to the deflection web; and wherein the light guide frame is configured to receive the light and direct the light toward the at least one key.

23. The keypad assembly of claim 22, wherein the light guide frame comprises a material having a high transmittance to visible light.

24. The keypad assembly of claim 22, wherein the light guide film is configured to receive the emitted light and communicate the received light to the light guide frame.

25. The keypad assembly of claim 22, wherein the light guide frame comprises at least one directional element configured for directing light toward the at least one key.

* * * * *